US009752475B2

(12) United States Patent
Peters et al.

(10) Patent No.: US 9,752,475 B2
(45) Date of Patent: Sep. 5, 2017

(54) EXHAUST SYSTEM FOR AN INTERNAL COMBUSTION ENGINE

(71) Applicant: AUDI AG, Ingolstadt (DE)

(72) Inventors: Axel Peters, Freising (DE); Siamak Alizadeh, Ingolstadt (DE); Gerd Verbeck, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 15/248,870

(22) Filed: Aug. 26, 2016

(65) Prior Publication Data

US 2017/0058733 A1 Mar. 2, 2017

(30) Foreign Application Priority Data

Aug. 27, 2015 (DE) ..... 10 2015 011 175

(51) Int. Cl.

| | |
|---|---|
| ***F01N 1/16*** | (2006.01) |
| ***F02M 26/14*** | (2016.01) |
| ***G10K 11/16*** | (2006.01) |
| ***F01N 13/02*** | (2010.01) |
| ***F01N 13/04*** | (2010.01) |
| ***F01N 13/00*** | (2010.01) |
| ***G10K 11/178*** | (2006.01) |
| *F01N 1/06* | (2006.01) |

(52) U.S. Cl.

CPC ..... *F01N 1/165* (2013.01); *F01N 1/166* (2013.01); *F01N 1/168* (2013.01); *F01N 13/011* (2014.06); *F01N 13/02* (2013.01); *F01N 13/04* (2013.01); *F02M 26/14* (2016.02); *G10K 11/161* (2013.01); *G10K 11/1788* (2013.01); *F01N 1/065* (2013.01)

(58) Field of Classification Search

CPC . F01N 1/165; F01N 1/16; F01N 1/161; F01N 1/163; F01N 1/065; F01N 1/166

USPC ..... 181/226, 227, 228

See application file for complete search history.

(56) References Cited

U.S. PATENT DOCUMENTS

| | | | | |
|---|---|---|---|---|
| 4,819,428 A * | 4/1989 | Ciccarone | F01N 13/08 | 181/228 |
| 4,913,260 A * | 4/1990 | Fallon | F01N 1/02 | 137/487.5 |
| 5,014,817 A * | 5/1991 | Takato | F01N 1/166 | 181/239 |
| 5,744,762 A * | 4/1998 | Seki | F01N 1/165 | 137/493 |

(Continued)

FOREIGN PATENT DOCUMENTS

| | | |
|---|---|---|
| CA | 2 139 122 C | 1/1994 |
| DE | 10 2011 108 058 A1 | 1/2013 |

(Continued)

*Primary Examiner* — Forrest M Phillips

(74) *Attorney, Agent, or Firm* — Henry M. Feiereisen LLC

(57) ABSTRACT

An exhaust system for an internal combustion engine includes a muffler, a first exhaust pipe which is connected to the muffler for sound damping, and a second exhaust pipe which extends in terms of flow in parallel relation to the first exhaust pipe and extends through first muffler in the absence of a flow communication with the first muffler. The first and second exhaust pipes originate from a common exhaust pipe. A switching valve adjusts hereby a throughflow cross section of the second exhaust pipe.

11 Claims, 2 Drawing Sheets

(56) References Cited

U.S. PATENT DOCUMENTS

| | | | | |
|---|---|---|---|---|
| 6,708,798 | B2 * | 3/2004 | Chang | F01N 1/082 181/226 |
| 7,673,720 | B2 * | 3/2010 | Meneely | F01N 1/02 181/212 |
| 7,686,130 | B1 * | 3/2010 | Quaglia | F01N 13/087 180/309 |
| 8,826,651 | B2 * | 9/2014 | Laube | F01N 1/166 181/211 |
| 2003/0115861 | A1 * | 6/2003 | Chang | F01N 1/006 60/323 |
| 2008/0302597 | A1 * | 12/2008 | Kruger | F01N 13/02 181/238 |
| 2014/0166394 | A1 * | 6/2014 | Winkel | F01N 13/107 181/228 |

FOREIGN PATENT DOCUMENTS

| | | | |
|---|---|---|---|
| DE | 10 2011 108 059 | A1 | 1/2013 |
| DE | 10 2012 112 433 | A1 | 6/2014 |
| JP | H 0990961 | A | 4/1997 |

* cited by examiner

EXHAUST SYSTEM FOR AN INTERNAL COMBUSTION ENGINE

CROSS-REFERENCES TO RELATED APPLICATIONS

This application claims the priority of German Patent Application, Serial No. 10 2015 011 175.2, filed Aug. 27, 2015, pursuant to 35 U.S.C. 119(a)-(d), the disclosure of which is incorporated herein by reference in its entirety as if fully set forth herein.

BACKGROUND OF THE INVENTION

The present invention relates to an exhaust system for an internal combustion engine.

The following discussion of related art is provided to assist the reader in understanding the advantages of the invention, and is not to be construed as an admission that this related art is prior art to this invention.

An exhaust system is provided to release exhaust from the internal combustion engine into the outside environment in particular and is thus in flow communication with to the internal combustion engine, typically via at least one exhaust valve and/or at least one exhaust manifold. The exhaust system includes exhaust pipes and a muffler for damping sound generated by the internal combustion engine and carried onward by the exhaust.

It would be desirable and advantageous to provide an improved exhaust system for an internal combustion engine to obviate prior art shortcomings and to attain superior acoustic characteristics while yet being of compact construction.

SUMMARY OF THE INVENTION

According to one aspect of the present invention, an exhaust system for an internal combustion engine includes a first muffler, a first exhaust pipe connected to the first muffler for sound damping, a second exhaust pipe extending in terms of flow in parallel relation to the first exhaust pipe and configured to extend through the in the absence of a flow communication with the first muffler, with the first and second exhaust pipes originating from a common exhaust pipe, and a switching valve configured to adjust a throughflow cross section of the second exhaust pipe.

In accordance with the present invention, the first and second exhaust pipes are both connected to the muffler or traverse the muffler. When referring to "originating from a common exhaust pipe", it is to be understood that the first and second exhaust pipes are arranged downstream of the common exhaust pipe so as to be in flow communication with the internal combustion engine via the common exhaust pipe. Thus, exhaust produced by the internal combustion engine flows first through the common exhaust pipe and is then split onto the first and second exhaust pipes. A "sound damping" connection of the first exhaust pipe to the muffler can be realized in that the first exhaust pipe enters an inner volume of the muffler and is breached there. Thus, exhaust from the internal combustion engine is able to enter the muffler and its inner volume via the first exhaust pipe and exit the muffler again via the first exhaust pipe In the muffler, exhaust is able to exit the first exhaust pipe via at least one outlet opening into the inner volume. Exhaust is then able to enter from the inner volume the first exhaust pipe again via at least one inlet opening and to exit the muffler via the first exhaust pipe.

The outlet opening and the inlet opening of the first exhaust pipe can be arranged in offset relation in the muffler or inner volume thereof. For example, an imaginary plane in which the inlet opening lies is arranged in parallel spaced-apart relation to an imaginary plane in which the outlet opening lies. It is, of course, also conceivable, to arrange the planes at an angle, i.e. at an angle greater than 0° and smaller than 180°. For example, the outlet opening may be provided in a first sub-section of the first exhaust pipe, while the inlet opening is provided in a second sub-section.

Provision may be made for the two sub-sections to be arranged inside the muffler or inner volume thereof in overlapping relation, i.e. extend at least in part side-by-side. The sub-sections or their longitudinal center axes can be arranged in parallel spaced-apart relation or at an angle to each other. It is, of course, also conceivable to provide a plurality of outlet openings and/or a plurality of inlet openings, associated to the first exhaust pipe, in particular to the first and second sub-sections.

While the first exhaust pipe is connected to the muffler in a sound-damping manner, the second exhaust pipe extends through the muffler in the absence of any flow communication with the inner volume of the muffler. Thus, the second exhaust pipe extends continuously without interruption through the muffler or the inner volume thereof. Even though the second exhaust pipe is arranged in part within, the muffler, exhaust flowing through the second exhaust pipe is fully separated from the inner volume of the muffler, so that no exhaust is able to escape the second exhaust pipe and escape into the muffler and the inner volume thereof, or able to enter the second exhaust pipe from the muffler.

Using the switching valve, the exhaust gas back pressure in the second exhaust pipe can be adjusted and the throughflow cross section of the second exhaust pipe can be adjusted. The switching valve can be constructed as discretely switching valve or as proportional valve. By adjusting the throughflow cross section of the second exhaust pipe, exhaust flowing through the common exhaust pipe can be selectively routed to flow through the first exhaust pipe, or the second exhaust pipe, or through both exhaust pipes. As a result, the switching valve can be used to influence which proportion of the exhaust should be sound-damped by the muffler. In this way, the noise level of the internal combustion engine can be influenced by using the switching valve.

According to another advantageous feature of the present invention, the switching valve can be configured as an exhaust gas recirculation valve, with an exhaust gas recirculation pipe disposed upstream of the switching valve branching off the second exhaust pipe or the common exhaust pipe. As the switching valve can be used to influence the exhaust gas back pressure in the second exhaust pipe, not only is it possible to influence the noise level of the internal combustion engine but in addition a mass flow rate of exhaust that is recirculated back to the internal combustion engine can be influenced. Thus, an exhaust system of the present invention can be used to realize also an exhaust gas recirculation by branching the exhaust gas recirculation pipe disposed upstream of the switching valve off the second exhaust pipe or the common exhaust pipe.

When the switching valve causes a full closure of the second exhaust pipe, i.e. the throughflow cross section is equal zero or substantially zero, the pressure in the exhaust gas recirculation pipe corresponds to the exhaust gas back pressure in the first exhaust pipe, which back pressure is primarily determined by the muffler. In view of the absence of a flow communication between the second exhaust pipe and the muffler, the second exhaust pipe causes a lower pressure loss than the first exhaust pipe. Thus, when the second exhaust pipe is fully opened, i.e. at maximum throughflow cross section, the exhaust gas back pressure or the exhaust gas pressure in the exhaust gas recirculation pipe is smaller than in case the second exhaust pipe is closed at least in part. The exhaust gas pressure required for recirculation of the exhaust in the exhaust gas recirculation pipe is advantageously greater than the exhaust gas pressure at fully open second exhaust pipe and smaller than the exhaust gas pressure at fully closed second exhaust pipe.

According to another advantageous feature of the present invention, the switching valve can be disposed downstream of the muffler. In principal, the switching valve may be arranged at or in any location of the second exhaust pipe in flow direction of the exhaust. Still, arrangement of the switching valve downstream of the muffler is currently preferred.

According to another advantageous feature of the present invention, the muffler can be constructed as rear muffler. The muffler thus represents the end or last muffler of the exhaust system as viewed in flow direction. Exhaust is thus released downstream of the muffler into the outside environment of the exhaust system, e.g. via an end pipe.

According to another advantageous feature of the present invention, at least one second muffler can be provided upstream of the first muffler, with the first exhaust pipe connected to the second muffler for sound damping, with the second exhaust pipe extending through the second muffler in the absence of a flow communication with the second muffler. Although an exhaust system according to the present invention may include a single muffler, the presence of at least one further muffler is thus conceivable as well. In fact, an exhaust system according to the present invention may include several mufflers. The at least one second muffler is connected, as described above with reference to the first muffler, to the first exhaust pipe for sound damping, whereas the second exhaust pipe extends through the second muffler but in terms of flow communication is decoupled therefrom. As a result, also the second muffler influences the pressure loss caused by the first exhaust pipe but not any pressure loss in the second exhaust pipe.

According to another advantageous feature of the present invention, the first exhaust pipe can cause a pressure loss which is greater than a pressure loss caused by the second exhaust pipe, when the switching valve is open. Thus, as already described above, when the switching valve assumes a position in which the second exhaust pipe is fully open so that the throughflow cross section is at a maximum, a lower pressure loss is established in the second exhaust pipe than in the first exhaust pipe, with the pressure loss in the first exhaust pipe being influenced predominantly by the first muffler and/or the at least one second muffler.

As already mentioned above, the switching valve can be constructed as discretely switching valve or as proportional valve. The discretely switching valve can have two states. In one state, the second exhaust pipe is fully open and has maximum throughflow cross section, and in another state, the second exhaust pipe is fully closed and has minimum throughflow cross section. Conversely, the provision of a proportional valve as switching valve enables adjustment of many different throughflow cross sections of the second exhaust pipe.

According to another advantageous feature of the present invention, an exhaust gas aftertreatment device may be disposed in the first exhaust pipe and/or the second exhaust pipe. The aftertreatment device may be constructed in the form of a catalytic converter or as Diesel particulate filter. The provision of several such aftertreatment devices in the first exhaust pipe and/or second exhaust pipe is, of course, also conceivable.

According to another advantageous feature of the present invention, a sound tube can be disposed downstream of the switching valve and feed into the second exhaust pipe. The sound tube is used to actively influence the noise level of the internal combustion engine. For example, a sound chamber can be connected in flow communication with the second exhaust pipe via the sound tube, with a loudspeaker being advantageously placed in the sound chamber. As a result, a vibration may be applied upon the exhaust flowing through the second exhaust pipe, in particular through appropriate activation of the loudspeaker.

According to another advantageous feature of the present invention, the first and second exhaust pipes feed into separate end pipes downstream of the muffler. The first and second exhaust pipes are thus connected to the outside environment via the end pipes. One end pipe thus connects the first exhaust pipe to the outside environment, and another end pipe connects the second exhaust pipe to the outside environment. Exhaust is thus directly released into the outside environment via the end pipes. There is no need to unite exhaust flowing in the first exhaust pipe and exhaust flowing in the second exhaust pipe before being released into the outside environment. This occurs once released into the outside environment.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
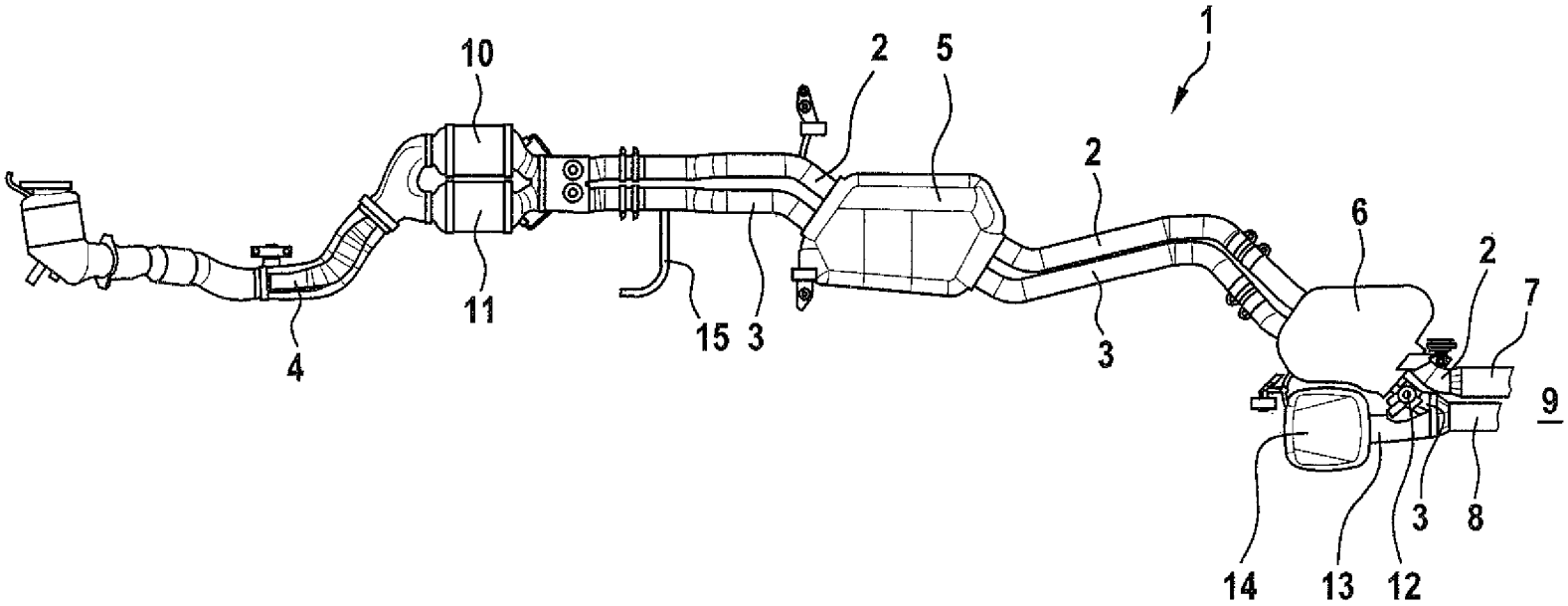
FIG. 1 is a schematic illustration of a portion of an exhaust system for an internal combustion engine in accordance with the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of a portion of an exhaust system for an internal combustion engine in accordance with the present invention, generally designated by reference numeral 1. The exhaust system 1 includes a first exhaust pipe 2 and a second exhaust pipe 3. Both exhaust pipes 2, 3 originate from a common exhaust pipe 4 via which the exhaust pipes 2, 3 are in flow communication with the internal combustion engine. In the non-limiting example of FIG. 1, the exhaust system 1 further includes a muffler 5 and a muffler 6, with the muffler 6 representing a rear muffler. The exhaust pipes 2, 3 feed downstream of the muffler 6 into end pipes 7, 8, respectively, via which exhaust, flowing in the exhaust pipes 2, 3, is released into the outside environment. Provision may be made for optional aftertreatment devices 10, 11 in the exhaust pipes 2, 3, respectively. The aftertreatment devices 10, 11 may, for example, each be configured as catalytic converter or particular filter.

As is readily apparent, the exhaust pipes 2, 3 extend each through both mufflers 5, 6. However, only the first exhaust pipe 2 is connected to the mufflers 5, 6 for sound damping. The second exhaust pipe 3, while extending through the mufflers 5, 6, is decoupled therefrom, i.e. there is no flow communication. Thus, vibrations in the exhaust flowing in the first exhaust pipe 2 are damped by the mufflers 5, 6 to a greater degree that vibrations in the exhaust flowing in the second exhaust pipe 3. Moreover, the mufflers 5, 6 cause a pressure loss in the first exhaust pipe 2, so that the first exhaust pipe 2 overall has a greater pressure loss than the second exhaust pipe 3.

A throughflow cross section of the second exhaust pipe 3 is advantageously adjustable via a switching valve 12. Using the switching valve 12, the pressure loss of the second exhaust pipe 3 and thus the exhaust gas back pressure in the second exhaust pipe 3 can be adjusted. The switching valve 12 can be constructed as discretely switching valve or as proportional valve. A sound tube 13 may, optionally, also be provided downstream of the muffler 6 or downstream of both mufflers 5, 6, but upstream of the end pipe 8, for feeding into the second exhaust pipe 3. For example, a sound chamber 14 is in flow communication with the second exhaust pipe 3 via the sound tube 13. A loudspeaker or the like may be arranged in the sound chamber 14. Vibrations may be applied upon exhaust, flowing through the second exhaust pipe 3, via the sound tube 13, so that the noise level of the internal combustion engine can be influenced.

An exhaust gas recirculation pipe 15 may branch off the second exhaust pipe 3 or the common exhaust pipe 4 upstream of the switching valve 12. This is shown in FIG. 1 purely by way of example. The exhaust gas recirculation pipe 15 is shown here to branch off the second exhaust pipe 5 upstream of the mufflers 5, 6.

Figure 2:
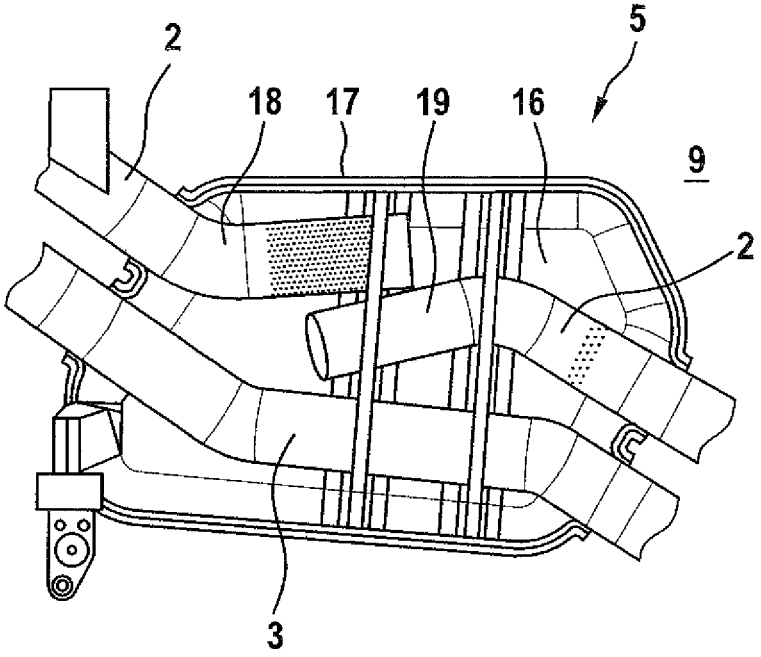
FIG. 2 is a detailed view, on an enlarged scale, of a muffler of the exhaust system.

FIG. 2 shows a detailed view, on an enlarged scale, of the muffler 5 of the exhaust system 1. It is to be understood that the principles described in the following description with respect to the muffler 5 are generally applicable to the muffler 6 as well. The muffler 5 has an inner volume 16 which is formed by a housing shell 17, advantageously two housing shells 17 that are fastened to one another, so as to be enclosed in a fluidtight manner against the outside environment. It is readily apparent that the first exhaust pipe 2 is connected in a sound damping manner to the muffler 5. The first exhaust pipe 2 has hereby, for example, a first sub-section 18 and a second sub-section 19. The sub-sections 18, 19 are accommodated in their entirety within the inner volume 16 but not connected in direct fluid communication with one another. Rather, the sub-sections 18, 19 are fluidly connected to one another indirectly via the inner volume 16.

Thus, exhaust conducted via the first exhaust pipe 2 exits inside the muffler 5 from the first sub-section 18 into the inner volume 16, then enters the second sub-section 19, and leaves the muffler 5 via the second sub-section 19 and the first exhaust pipe 2 for subsequent conduction in the direction of the outside environment. The second exhaust pipe 3 is also arranged in the muffler 5 and its inner volume 16. In contrast to the first exhaust pipe 2, the second exhaust pipe 3 extends continuously through the muffler 5 in the absence of any flow communication with the inner volume 16 of the muffler 5. In other words, the second exhaust pipe 3 is decoupled from the muffler 5 and separated from the inner volume 16 so that exhaust flowing through the second exhaust pipe 3 cannot escape into the inner volume 16 or exhaust is unable to enter the second exhaust pipe 3 from the inner volume 16.

As a result of such a configuration of an exhaust system 1 according to the present invention, different exhaust gas back pressures are established in the first and second exhaust pipes 2, 3, when the switching valve 12 fully opens the second exhaust pipe 3. In the presence of a fully open second exhaust pipe 3, exhaust predominantly flows there through. Using the switching valve 12, exhaust flowing via the common exhaust pipe 4 may, however, be split to flow through the first exhaust pipe 2 and the second exhaust pipe 3. Therefore, the noise level of the internal combustion engine can be adjusted and the mass flow rate of exhaust recirculated to the internal combustion engine may be adjusted as well with the assistance of the switching valve 12.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An exhaust system for an internal combustion engine, comprising:

a first muffler;

a first exhaust pipe connected to the first muffler for sound damping;

a second exhaust pipe extending in terms of flow in parallel relation to the first exhaust pipe and configured to extend through the first muffler in the absence of a flow communication with the first muffler, said first and second exhaust pipes originating from a common exhaust pipe;

a switching valve configured to adjust a throughflow cross section of the second exhaust pipe; and at least one second muffler disposed upstream of the first muffler, said first exhaust pipe connected to the second muffler for sound damping, said second exhaust pipe extending through the second muffler in the absence of a flow communication with the second muffler.

2. The exhaust system of claim 1, wherein the switching valve is configured as an exhaust gas recirculation valve, further comprising an exhaust gas recirculation pipe disposed upstream of the switching valve branching off the second exhaust pipe or the common exhaust pipe.

3. The exhaust system of claim 1, wherein the switching valve is disposed downstream of the muffler.

4. The exhaust system of claim 1, wherein the first muffler is constructed as rear muffler.

5. The exhaust system of claim 1, wherein the first exhaust pipe causes a pressure loss which is greater than a pressure loss caused by the second exhaust pipe, when the switching valve is open.

6. The exhaust system of claim 1, wherein the switching valve is constructed as discretely switching valve or as proportional valve.

7. The exhaust system of claim 1, further comprising an exhaust gas aftertreatment device disposed in at least one of the first and second exhaust pipes.

8. The exhaust system of claim 1, further comprising a sound tube disposed downstream of the switching valve and feeding into the second exhaust pipe.

9. The exhaust system of claim 1, wherein the first and second exhaust pipes feed into separate end pipes downstream of the first muffler.

10. The exhaust system of claim 1, wherein the first exhaust pipe is of discontinuous configuration inside the first muffler to define a first sub-section and a second sub-section to enable exhaust to enter an inner volume of the first muffler from the first sub-section and to enable exhaust to enter the second sub-section from the inner volume of the first muffler.

11. The exhaust system of claim 1, wherein the first and second sub-sections of the first exhaust pipe overlap one another so as to extend side-by-side.

* * * * *